US007383762B2

(12) United States Patent
Cohen

(10) Patent No.: US 7,383,762 B2
(45) Date of Patent: Jun. 10, 2008

(54) CERAMIC PELLETS AND COMPOSITE ARMOR PANEL CONTAINING THE SAME

(76) Inventor: Michael Cohen, Kibbutz Kfar Etzion, Mobile Post North Yehuda 90200 (IL)

( * ) Notice: Subject to any disclaimer, the term of this patent is extended or adjusted under 35 U.S.C. 154(b) by 114 days.

(21) Appl. No.: 11/327,528

(22) Filed: Jan. 5, 2006

(65) Prior Publication Data

US 2006/0243127 A1 Nov. 2, 2006

(30) Foreign Application Priority Data

Apr. 3, 2005 (IL) ..... 167825
Apr. 14, 2005 (IL) ..... 168029

(51) Int. Cl.
*F41H 5/007* (2006.01)

(52) U.S. Cl. ..... 89/36.02; 89/36.01; 428/911

(58) Field of Classification Search ..... 89/36.01, 89/36.02; 428/911; 109/82–84
See application file for complete search history.

(56) References Cited

U.S. PATENT DOCUMENTS 3,705,558 A 12/1972 McDougal et al.

(Continued)

FOREIGN PATENT DOCUMENTS

| | | |
|---|---|---|
| EP | 0843149 A1 | 11/1996 |
| EP | 0942255 A1 | 3/1998 |
| FR | 2711782 | 7/1991 |
| GB | 1081464 | 8/1964 |
| GB | 1352418 | 5/1974 |
| GB | 2272272 | 11/1992 |
| WO | WO 98/15796 | 10/1997 |
| WO | WO 99/60327 | 5/1999 |

*Primary Examiner*—Bret Hayes
(74) *Attorney, Agent, or Firm*—Billy A. Robbins; Connolly Bove Lodge & Hutz LLP

(57) ABSTRACT

The invention provides a composite armor plate for absorbing and dissipating kinetic energy from high velocity, armor-piercing projectiles, as well as from soft-nosed projectiles, the plate comprising a single internal layer of pellets which are bound and retained in plate form by an elastic material, substantially internally within the elastic material, such that the pellets are bound in a plurality of rows and columns providing mutual lateral support, the pellets being made of ceramic material, wherein a majority of each of the pellets is substantially in contact with at least three adjacent pellets and at least a majority of the pellets are substantially cylindrical in shape with at least one convexly-curved end face, further characterized in that spaces formed between the adjacent cylindrical pellets are only partially filled with a material for preventing the flow of soft metal from impacting projectiles through the spaces, the flow-preventing material being in the form of an insert which is in contact with at most only one of the sides of three adjacent cylindrical pellets, or being integrally formed as part of a special insert pellet, the insert pellet being in the form of a cylinder provided with projections extending only partially into the spaces formed between the sides of six adjacent cylindrical pellets, and blocking a major cross-sectional portion of the spaces, each of the projections being in spaced-apart relationship to at least one of the two adjacent cylinders towards which it projects, the pellets and the flow-preventing material being bound and retained in plate form by a solidified material, wherein the solidified material and the plate are elastic.

18 Claims, 7 Drawing Sheets

U.S. PATENT DOCUMENTS 4,061,815 A 12/1977 Poole, Jr.
4,529,640 A 7/1985 Brown et al.
4,534,266 A 8/1985 Huet
4,836,084 A 6/1989 Vogelesang et al.
4,868,040 A 9/1989 Hallal et al.
4,945,814 A 8/1990 Huet
5,120,483 A * 6/1992 Cameron et al. ..... 264/658
5,361,678 A 11/1994 Roopchand et al.
5,738,925 A * 4/1998 Chaput ..... 428/101
5,763,813 A 6/1998 Cohen et al.
5,915,528 A * 6/1999 Shmuelov ..... 2/2.5
5,972,819 A 10/1999 Cohen
6,112,635 A 9/2000 Cohen
6,203,908 B1 3/2001 Cohen
6,289,781 B1 9/2001 Cohen
6,408,734 B1 6/2002 Cohen
6,497,966 B2 12/2002 Cohen
6,575,075 B2 * 6/2003 Cohen ..... 89/36.02
2004/0020353 A1 * 2/2004 Ravid et al. ..... 89/36.02

* cited by examiner

FIGURE 8

H.P. White Laboratory, Inc.
BALLISTIC RESISTANCE TEST

Client : MOFET ETZION
Job No. : 9751-01 Test Date : 3/3/05

TEST PANEL

Manufacturer : MOFET ETZION
Size : 10x12 in.
Thicknesses : NA
Avg. Thick. : NA
Description : STAR + 13mm DYNEEMA Sample No. : STAR
Weight : 8.08 lbs.
Hardness : NA
Piles/Laminates : NA Date Rec'd. : 2/25 & 3/2/05
Via : FedEx & HAND CARF
Returned : NA

SET-UP

Shot Spacing : PER CUSTOMER REQUEST
Witness Panel : 0.020", 2024-T3 ALUMINUM
Obliquity : 0 deg.
Backing Material : NA
Conditioning : AMBIENT Primary Vel. Screens : 10.0 ft., 20.0 ft.
Primary Vel. Location : 15.0 ft. From Muzzle
Residual Vel. Screens : NA
Residual Vel. Location : NA
Range to Target : 25.0 ft.
Target to Wit. : 6.0 in.

Range No. : 1
Temp. : 69 F
BP : 29.93 in. Hg
RH : 24%
Barrel No./Gun : TEST BARREL
Gunner : INGRAM
Recorder : THOMAS

AMMUNITION (1) : 7.62mm AP, M61, 150 gr. Lot No. : 01FNB88
(2) : Lot No. :
(3) : Lot No. :
(4) : Lot No. :

APPLICABLE STANDARDS OR PROCEDURES (1) : PER CUSTOMER REQUEST
(2) :
(3) :

| Shot No. | Ammo. | Time 1 (usec) | Velocity 1 (ft/s) | Time 2 (usec) | Velocity 2 (ft/s) | Avg. Vel. (ft/s) | Vel. Loss (ft/s) | Strike Vel. (ft/s) | Penetration | Footnotes |
|---|---|---|---|---|---|---|---|---|---|---|
| 1 | 1 | 3620 | 2762 | 3621 | 2762 | 2762 | 8 | 2754 | Bullet/Spall | |
| 2 | 1 | 3598 | 2779 | 3599 | 2779 | 2779 | 8 | 2771 | None | |
| 3 | 1 | 3603 | 2775 | 3603 | 2775 | 2775 | 8 | 2768 | None | |
| 4 | 1 | 3612 | 2769 | 3614 | 2767 | 2768 | 8 | 2760 | None | |
| 5 | 1 | 3593 | 2783 | 3595 | 2782 | 2782 | 8 | 2775 | None | |
| 6 | 1 | 3620 | 2762 | 3622 | 2761 | 2762 | 8 | 2754 | None | |
| 7 | 1 | 3594 | 2782 | 3596 | 2781 | 2782 | 8 | 2774 | None | |

FIGURE 9

H.P. White Laboratory, Inc.
BALLISTIC RESISTANCE TEST

Client : MOFET ETZION
Job No. : 9751-01 Test Date : 3/3/05

TEST PANEL

Manufacturer : MOFET ETZION
Size : 10x12 in.
Thicknesses : NA
Avg. Thick. : NA
Description : CROWNS + 13mm DYNEEMA Sample No. : CROWNS
Weight : 7.68 lbs.
Hardness : NA
Plies/Laminates : NA Date Rec'd. : 2/25 & 3/3/05
Via : FedEx / HAND CARF
Returned : NA

SET-UP

Shot Spacing : PER CUSTOMER REQUEST
Witness Panel : 0.020" 2024-T3 ALUMINUM
Obliquity : 0 deg.
Backing Material : NA
Conditioning : AMBIENT Primary Vel. Screens : 10.0 ft., 20.0 ft.
Primary Vel. Location : 15.0 ft. From Muzzle
Residual Vel. Screens : NA
Residual Vel. Location : NA
Range to Target : 25.0 ft.
Target to Wit. : 6.0 in.

Range No. : 1
Temp. : 69 F
BP : 29.93 In. Hg
RH : 24%
Barrel No./Gun : TEST BARREL
Gunner : INGRAM
Recorder : THOMAS

AMMUNITION (1) : 7.62mm AP, M61, 150 gr. Lot No. : 01FNB88
(2) : Lot No. :
(3) : Lot No. :
(4) : Lot No. :

APPLICABLE STANDARDS OR PROCEDURES (1) : PER CUSTOMER REQUEST
(2) :
(3) :

| Shot No. | Ammo. | Time 1 (usec) | Velocity 1 (ft/s) | Time 2 (usec) | Velocity 2 (ft/s) | Avg. Vel. (ft/s) | Vel. Loss (ft/s) | Strike Vel. (ft/s) | Penetration | Footnotes |
|---|---|---|---|---|---|---|---|---|---|---|
| 1 | 1 | 3580 | 2793 | 3581 | 2793 | 2793 | 8 | 2785 | None | |
| 2 | 1 | 3579 | 2794 | 3581 | 2793 | 2793 | 8 | 2786 | None | |
| 3 | 1 | 3601 | 2777 | 3602 | 2776 | 2777 | 8 | 2769 | None | |
| 4 | 1 | 3578 | 2795 | 3580 | 2793 | 2794 | 8 | 2786 | None | |
| 5 | 1 | 3578 | 2795 | 3578 | 2795 | 2795 | 8 | 2787 | None | |
| 6 | 1 | 3573 | 2799 | 3574 | 2798 | 2798 | 8 | 2791 | None | |
| 7 | 1 | 3600 | 2778 | 3601 | 2777 | 2777 | 8 | 2770 | None | |
| 8 | 1 | 3585 | 2789 | 3588 | 2787 | 2788 | 8 | 2781 | None | |
| 9 | 1 | 3599 | 2779 | 3601 | 2777 | 2778 | 8 | 2770 | None | |
| 10 | 1 | 3598 | 2779 | 3600 | 2778 | 2779 | 8 | 2771 | None | |

CERAMIC PELLETS AND COMPOSITE ARMOR PANEL CONTAINING THE SAME

The present invention relates to a ceramic body for deployment in a composite armor panel, for absorbing and dissipating kinetic energy from projectiles and to ballistic armor panels incorporating the same. More particularly, the invention relates to improved ceramic bodies for use in armored plates for providing ballistic protection for light and heavy mobile equipment and for vehicles against high-velocity, armor-piercing projectiles or fragments as well as from soft nosed projectiles.

The present invention is a modification of the inventions described in U.S. Pat. Nos. 5,763,813; 5,972,819; 6,289,781; 6,112,635; 6,203,908; and 6,408,734 and in WO-A-9815796 the relevant teachings of which are incorporated herein by reference.

In U.S. Pat. No. 5,763,813 there is described and claimed a composite armor material for absorbing and dissipating kinetic energy from high velocity, armor-piercing projectiles, comprising a panel consisting essentially of a single internal layer of high density ceramic pellets said pellets having an $Al_2O_3$ content of at least 93% and a specific gravity of at least 2.5 and retained in panel form by a solidified material which is elastic at a temperature below 250° C.; the majority of said pellets each having a part of a major axis of a length of in the range of about 3-12 mm, and being bound by said solidified material in plurality of superposed rows, wherein a majority of each of said pellets is in contact with at least 4 adjacent pellets, the weight of said panel does not exceed 45 kg/m$^2$.

In U.S. Pat. No. 6,112,635 there is described and claimed a composite armor plate for absorbing and dissipating kinetic energy from high velocity, armor-piercing projectiles, said plate consisting essentially of a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length said one axis of substantially all of said pellets being in substantial parallel orientation with each other and substantially perpendicular to an adjacent surface of said plate and wherein a majority of each of said pellets is in direct contact with 6 adjacent pellets, and said solidified material and said plate are elastic.

In WO-A-9815796 corresponding to U.S. Pat. No. 5,972,819, there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In U.S. Pat. No. 6,289,781 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

In U.S. Pat. No. 6,408,734 there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

The teachings of all of these specifications are incorporated herein by reference.

As described and explained therein, an incoming projectile may contact the pellet array in one of three ways:

1. Center contact. The impact allows the full volume of the pellet to participate in stopping the projectile, which cannot penetrate without pulverizing the whole pellet, an energy-intensive task.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the substrate or plate, and penetration is prevented.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm and above, since the weight of standard armor to withstand such projectile is such as to impede the mobility and performance of such vehicles.

A second consideration is cost. Overly complex armor arrangements, particularly those depending entirely on composite materials, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

In the majority of the patents by the present inventor, the preferred embodiments are pellets having a cylindrical body and at least one convexly curved end face and the especially preferred embodiment is that described in U.S. Pat. No. 5,972,819 wherein the body is substantially cylindrical in shape with at least one convexly curved end face, and preferably two identical convexly curved end faces, wherein the ratio D/R between the diameter D of said cylindrical body and the radius R of curvature of said convexly curved end faces is at least 0.64:1.

Other especially preferred embodiments are described and claimed in U.S. Pat. No. 6,408,734 in which there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

While this embodiment has been found to be especially effective against high speed armor piercing projectiles or fragments as well as from soft nosed projectiles, it has now surprisingly and counter intuitively been discovered that unexpectedly superior multi-hit capability is achieved with more spaces rather than less spaces between the pellets.

Thus according to the present invention, there is now provided a composite armor plate for absorbing and dissipating kinetic energy from high velocity, armor-piercing projectiles, as well as from soft-nosed projectiles, said plate comprising a single internal layer of pellets which are bound and retained in plate form by an elastic material, substantially internally within said elastic material, such that the pellets are bound in a plurality of rows and columns providing mutual lateral support, said pellets being made of ceramic material, wherein a majority of each of said pellets is substantially in contact with at least three adjacent pellets and at least a majority of said pellets are substantially cylindrical in shape with at least one convexly-curved end face, further characterized in that spaces formed between said adjacent cylindrical pellets are only partially filled with a material for preventing the flow of soft metal from impacting projectiles through said spaces, said flow-preventing material being in the form of an insert which is in contact with at most only one of the sides of three adjacent cylindrical pellets, or being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to at least one of the two adjacent cylinders towards which it projects, said pellets and said flow-preventing material being bound and retained in plate form by a solidified material, wherein said solidified material and said plate are elastic.

In the embodiments wherein said flow-preventing material is in the form of an insert which is in contact with at most only one of the sides of three adjacent cylindrical pellets, said inserts can be made of any suitable material. Especially preferred are inserts made from material selected from the group consisting of ceramic material, or any other suitable ballistics material such as hard metals like steel and titanium.

It is to be realized that as the diameter of the adjacent cylindrical pellets increases, the space between the pellets also increases and the function of the protrusions assumes greater significance.

In especially preferred embodiments of the present invention there is provided a composite armor plate for absorbing and dissipating kinetic energy from high velocity, armor-piercing projectiles, as well as from soft-nosed projectiles, said plate comprising a single internal layer of pellets which are bound and retained in plate form by an elastic material, substantially internally within said elastic material, such that the pellets are bound in a plurality of rows and columns providing mutual lateral support, said pellets being made of ceramic material, wherein a majority of each of said pellets is substantially in contact with at least three adjacent pellets and at least a majority of said pellets are substantially cylindrical in shape with at least one convexly-curved end face, further characterized in that spaces formed between said adjacent cylindrical pellets are only partially filled with a material for preventing the flow of soft metal from impacting projectiles through said spaces, said flow-preventing material being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to at least one of the two adjacent cylinders towards which it projects, said pellets being bound and retained in plate form by a solidified material, wherein said solidified material and said plate are elastic.

In preferred embodiments of the present invention there is provided a composite armor plate as defined above, wherein said projections are in the form of lateral protrusions from substantially vertical surfaces of said substantially cylindrical insert pellet said protrusions being separated from each other by convexly curved surface areas of said insert pellet.

In preferred embodiments of the present invention the height of said projections is less than the height of the cylindrical bodies from which they project.

In first embodiments of the present invention said projections are provided with substantially semi-cylindrical surfaces.

In other preferred embodiments of the present invention, said projections are substantially in the form of outwardly tapered triangular prisms.

In yet other preferred embodiments of the present invention wherein said projections emerge slantingly from said cylindrical pellet, have substantially semi-circular surfaces, and end face that merges with a convexly curved end face of said cylindrical pellet.

In a preferred aspect of the present invention, there is provided an insert pellet for use in a composite armor plate for absorbing and dissipating kinetic energy from high velocity, armor-piercing projectiles, as well as from soft-nosed projectiles said insert pellet being in the form of a cylinder provided with projections in the form of lateral protrusions from substantially vertical surfaces of said substantially cylindrical insert pellet said protrusions being separated from each other by convexly curved surface areas of said insert pellet.

The function of said preferred insert pellet having lateral protrusions on its vertical surfaces is to help stop, slow, arrest or otherwise degrade the effectiveness of projectiles with small diameters such as are use in the SS109 bullet, which might impact in an area found in the intersection between 3 ceramic bodies of a ceramic plate, as described hereinbefore. This function of the insert pellet having lateral protrusions on its vertical surface in stopping, arresting, slowing or otherwise degrading the effectiveness of projectiles, is also to reduce damage to backing layers used with composite armor plates in which these insert pellets are incorporated, and as result allows for a reduction in the thickness of the backing material.

Similarly, when defeating a standard lead-core projectile, said preferred insert pellets having lateral protrusions on their vertical surfaces, the damage to backing layers, is significantly reduced in comparison to a panel without such an insert pellet incorporated therein, and as a result, a significant reduction in the thickness, cost and weight of the backing layers is enabled.

In another aspect of the present invention, there is now provided an insert pellet for use in a composite armor plate for absorbing and dissipating kinetic energy from high velocity, armor-piercing projectiles, as well as from soft-nosed projectiles, said plate being of the type comprising a single internal layer of pellets which are bound and retained in plate form by an elastic material, substantially internally within said elastic material, such that the pellets are bound in a plurality of rows and columns providing mutual lateral support, said pellets being made of ceramic material, wherein a majority of each of said pellets is substantially in contact with at least three adjacent pellets and at least a majority of said pellets are substantially cylindrical in shape with at least one convexly-curved end face, said insert pellet being in the form of a cylinder provided with projections in the form of lateral protrusions from substantially vertical surfaces of said substantially cylindrical insert pellet said protrusions being separated from each other by convexly curved surface areas of said insert pellet.

The height of the lateral protrusions along the vertical surface of the ceramic body from which they depend can be from 10-100% of the vertical axis. As stated, unlike the star-shaped insert pellet described and claimed in U.S. Pat. No. 6,408,734, said protrusions do not completely fill the space found in the intersection between 3 ceramic bodies, but can function in the same way without touching any of the adjacent pellets.

Thus in preferred embodiments of the present invention, there is provided an insert pellet as defined above wherein the height of said projections is less than the height of the cylindrical body from which they project.

In other preferred embodiments of the present invention, there is provided an insert pellet as defined above, wherein said projections are provided with substantially semi-cylindrical surfaces.

In yet other preferred embodiments of the present invention, there is provided an insert pellet as defined above wherein said projections are substantially in the form of outwardly tapered triangular prisms.

The insert pellets of the present invention can also be used in conjunction with the ceramic bodies described and claimed in Israel Patent Application 158,237 which pellets are defined as being made of a ceramic material and being characterized by a substantially regular geometric cross-sectional area, said cross-sectional area being substantially polygonal with rounded corners.

Similarly the insert pellets of the present invention can be used in conjunction with the ceramic plates and panels described and claimed in Israel Patent Application 166,147 which plates are defined as having a plurality of convexly curved upper surface areas wherein the curvature of 3 of such curved surfaces converged together to form a valley bounded only by said 3 surfaces.

In fact, the insert pellets of the present invention can be used in conjunction with pellets of any geometric shape which when placed side by side in a composite armor plate have substantially through-going spaces at the juncture of valley contact between the pellets.

The term "elasticity" as used herein relates to the fact that the plates according to the present invention are bent when a load is applied thereto however upon release of said load the plate tends to return to its original shape, or close to its original shape.

While the cylindrical pellets of the present invention are defined as being substantially in contact with at least three adjacent pellets, it is known that a ceramic body which has been pressed, by it's nature, has an external surface area which is not smooth and has lack of consistency in its diameter along the main axis, and it is because of this that when casting the panel with the solidified material, the casting material(s) (resin, molten alumina, epoxy, and so on) seeps into spaces between the ceramic bodies (for instance, cylinders and spheres and so on), including the very small spaces found between the walls of two or more adjoining cylinders, forming a natural retaining substance in which the ceramic bodies are confined. Thus even when the ceramic bodies are closely packed, the casting material will at least partially penetrate between them. This is due to the fact that during the pressing process, the ceramic material is compacted in the die and when the material is released from the die the material has a tendency to try and spring back to a less compact form. This generally occurs in the top part of the material so pressed, which is the first part of the body released from the die. Thus, in this case, there will be a small difference in the diameter of the body along the vertical axis. Secondly, it is well known that during the pressing process there are sometimes differences in densification of the powder in different areas of the ceramic body. When sintering the ceramic body, these small differences will cause the body to shrink in accordance with the different compressions found in various areas of the body, resulting in another reason for a small lack of homogeneity in the diameter along the vertical axis of the body. Thus there is rarely a situation in which one ceramic body is perfectly in direct contact with a second ceramic body in the panel, rather, the casting material will seep between the two bodies, at least partially encasing each of said bodies and the term substantially in contact is intended to also denote this possibility.

Furthermore, when the casting material of the plate is a liquefied solid material, if one were to x-ray the panel, one would see that the panel shows a honey-combed shaped casting, which at least partially encloses the ceramic bodies. Since this is the case, it is possible also to first cast such a partial honey-comb-like shape and then to place the special insert pellets and the other pellets in the proper configuration therein as seen with reference to appended FIGS. 6 and 7.

The armor plates described in EP-A-0843149 and European Patent Application 98301769.0 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using pellets made of sintered refractory materials or ceramic materials having a specific gravity below that of aluminum oxide, e.g., boron carbide with a specific gravity of 2.45, silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdenum, titanium and silica can be used. Especially preferred for use in said publication and also for use in the ceramic insert bodies of the present invention, is a ceramic material selected from the group consisting of sintered oxide, nitrides, carbides and borides of alumina, magnesium, zirconium, tungsten, molybdenum, titanium and silica although any suitable or newly discovered ceramic material can be used for forming the inserts and insert pellets of the present invention.

All of these features are incorporated herein as preferred embodiments of the present invention.

More particularly, the present invention relates to a ceramic body as defined for absorbing and dissipating kinetic energy from high velocity armor piercing projectiles, wherein said body is made of a material selected from the group consisting of alumina, boron carbide, boron nitride, titanium diboride, silicon carbide, silicon oxide, silicon nitride, magnesium oxide, silicon aluminum oxynitride and mixtures thereof.

In preferred embodiments of the present invention said pellets each have a major axis and said pellets are arranged with their major axes substantially parallel to each other and oriented substantially perpendicularly relative to said outer impact-receiving major surface of said panel.

Thus, in preferred embodiments of the present invention there is provided a composite armor plate as herein defined, wherein a majority of said pellets have at least one convexly-curved end face oriented to substantially face in the direction of an outer impact receiving major surface of said plate.

The solidified material can be any suitable material, such as aluminum, a thermoplastic polymer such as polycarbonate, or a thermoset plastic such as epoxy or polyurethane.

When aluminum is used as said solidified material an x-ray of the plate shows the formation of a honeycomb structure around the pellets.

In French Patent 2,711,782, there is described a steel panel reinforced with ceramic materials; however said panel does not have the ability to deflect armor-piercing projectiles unless a thickness of about 8-9 mm of steel is used, which adds undesirable excessive weight to the panel and further backing is also necessary thereby further increasing the weight thereof.

The composite armor plate according to the present invention can be used in conjunction with and as an addition to the standard steel plates provided on armored vehicles or as add on armor for armored vehicles having aluminum or titanium containing rigid surfaces, as well as in conjunction with the laminated armor described and claimed in U.S. Pat. No. 6,497,966 the teachings of which are incorporated herein by reference.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising a ballistic material for absorbing the remaining kinetic energy from said fragments. Said ballistic material will be chosen according to cost and weight considerations and can be made of any suitable material such as Dyneema, Kevlar, aluminum, steel, titanium, or S2.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 mm and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

As will be realized, when preparing the composite armor plate of the present invention, said pellets do not necessarily have to be completely covered on both sides by said solidified material, and the term internal layer as used herein is intended to denote that the pellets are either completely or almost completely covered by said solidified material, wherein outer face surfaces of the plate are formed from the solidified material, the plate having an outer impact receiving face, at which face each pellet is either covered by the solidified material, touches said solidified material which forms surfaces of said outer impact receiving face or, not being completely covered by said solidified material which constitutes surfaces of said outer impact receiving face, bulges therefrom, the solidified material and hence the plate being elastic.

In U.S. Ser. No. 09/924745 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments described therein each of said channels occupies a volume of up to 25% within its respective pellet.

Said channels can be bored into preformed pellets or the pellets themselves can be pressed with said channel already incorporated therein.

The teachings of said specification are also incorporated herein by reference.

Thus, in preferred embodiments of the present invention a channel is provided in the pellets of the armor of the present invention to further reduce the weight per area thereof and preferably said channel occupies a volume of up to 25% of said body.

In accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

As will be realized, since material is removed from the pellets of the present invention their weight is decreased, as is the overall weight of the entire composite armor plate from which they are formed, thereby providing the unexpected improvement of reduced weight of protective armor panels without loss of stopping power.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 5A:
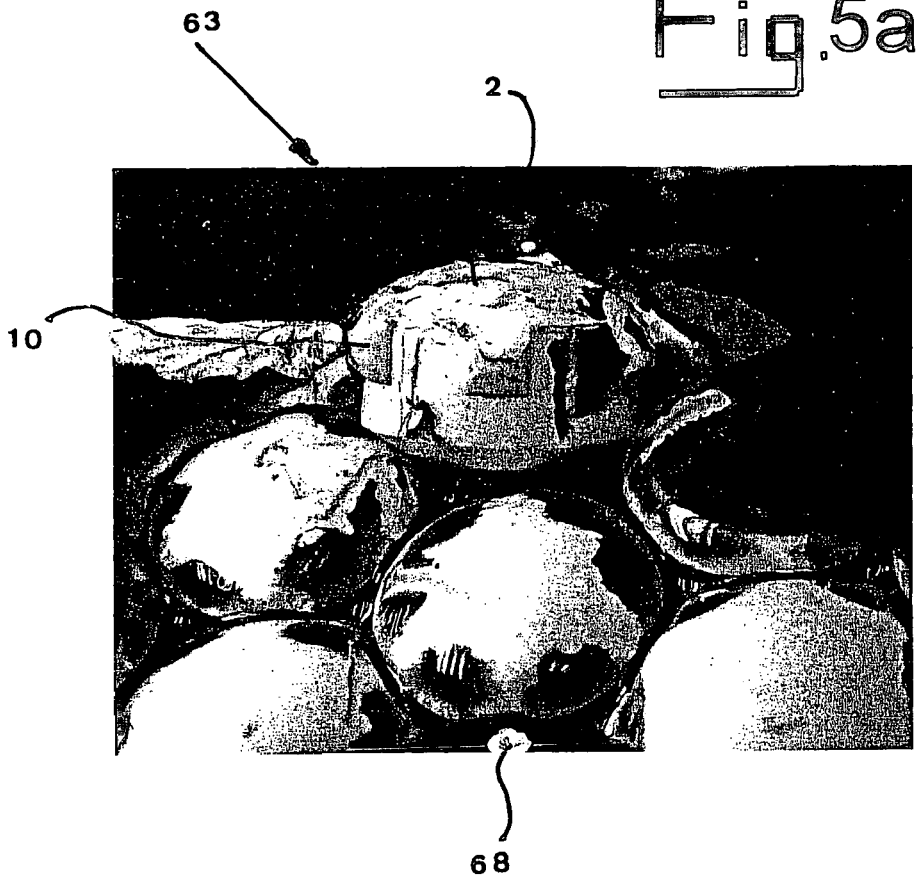
Figure 5B:
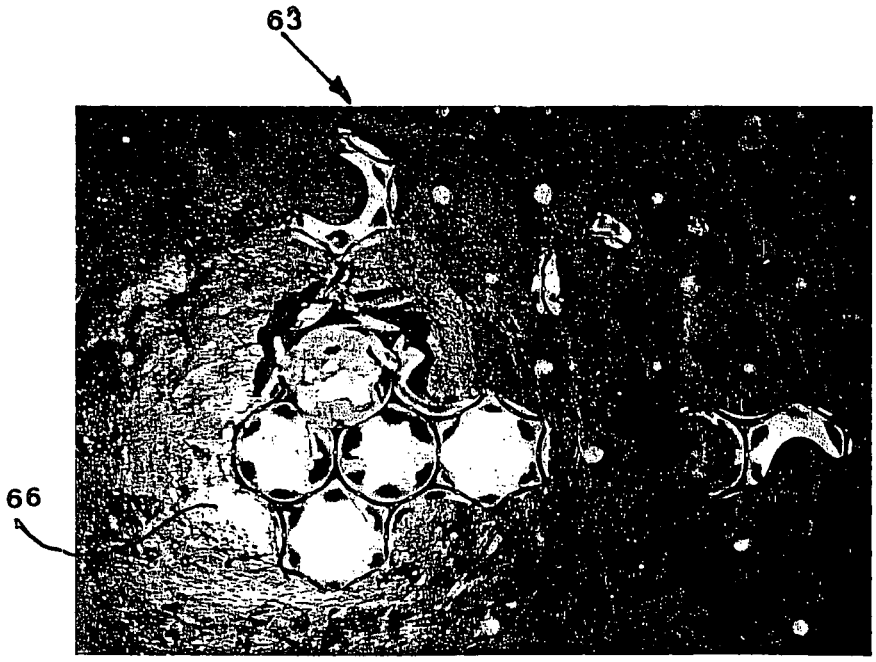
Figure 6:
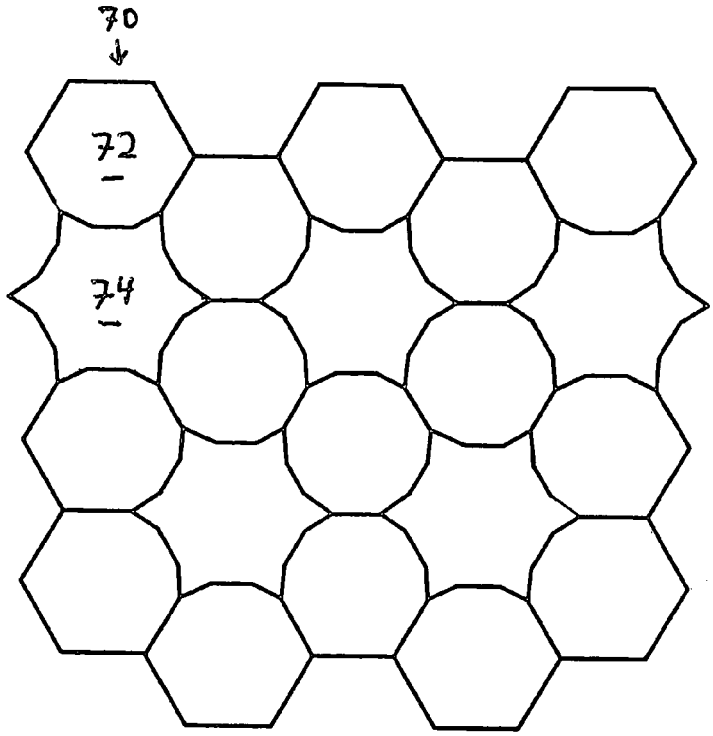
Figure 7:
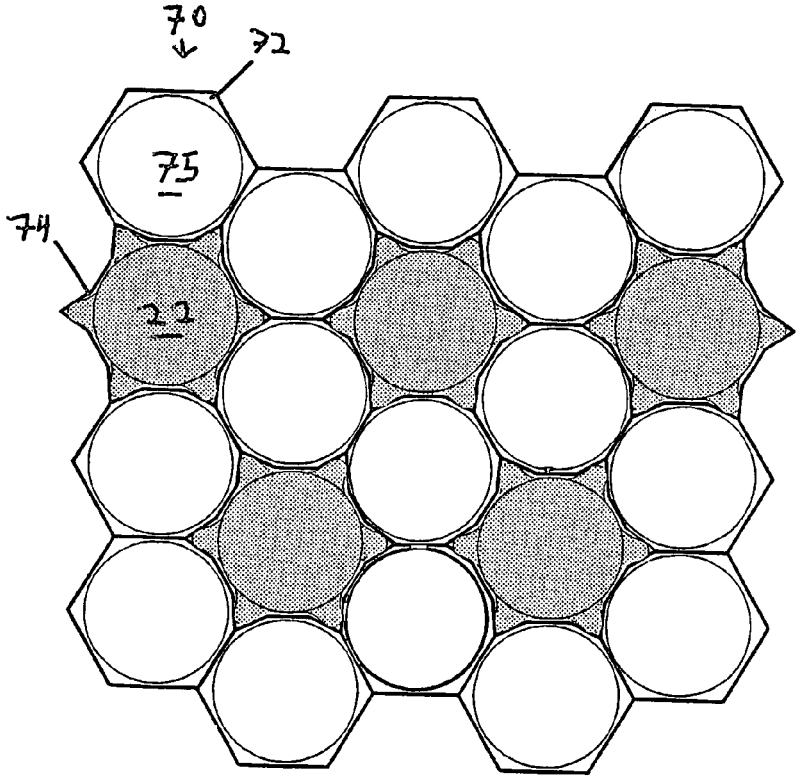

FIG. 4 is a presentation of 4 photographs of a plate prepared according to U.S. Pat. No. 6,408,734, that was submitted to a ballistic resistance test, the first photograph being before shooting and the other three photographs being after shooting;

FIG. 5 is a presentation of two photographs of a plate prepared according to the present invention wherein in the first photograph the insert pellet is raised to show its configuration, and in the second photograph there is seen the distribution of the insert pellets in combination with cylindrical pellets in a plate that was submitted to a ballistic resistance test;

FIG. 6 is a top view of a segment of a honeycomb-like structure preformed for the insertion of substantially cylindrical pellets and insert pellets according to the present invention therein; and FIG. 7 is a top view of a segment of the honeycomb-like structure of FIG. 6 with substantially cylindrical pellets and insert pellets according to the present invention inserted therein.

Figure 1:
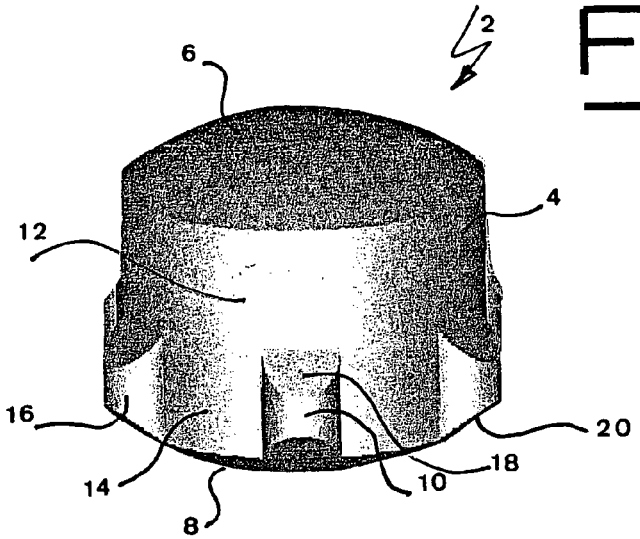
FIG. 1 is a perspective view of a first preferred pellet according to the present invention.

Referring to FIG. 1 there is seen a perspective view of a preferred insert pellet 2 according to the present invention having a substantially cylindrical body 4 and two convexly curved end faces 6 and 8. As can be seen, said cylindrical body 4 is provided with a plurality of projections 10 which are in the form of lateral protrusions 10 from substantially vertical surfaces 12 of said substantially cylindrical insert pellet 2 said protrusions 10 being separated from each other by convexly curved surface areas 14 of said insert pellet 2. As will be noted the height H of said protrusions 10 is less than the height h of the cylindrical bodies from which they project.

In this embodiment, said projections 10 are provided with substantially semi-cylindrical surfaces 16 and preferably both the upper 18 and lower 20 faces of said protrusions 10 are beveled.

Figure 2:
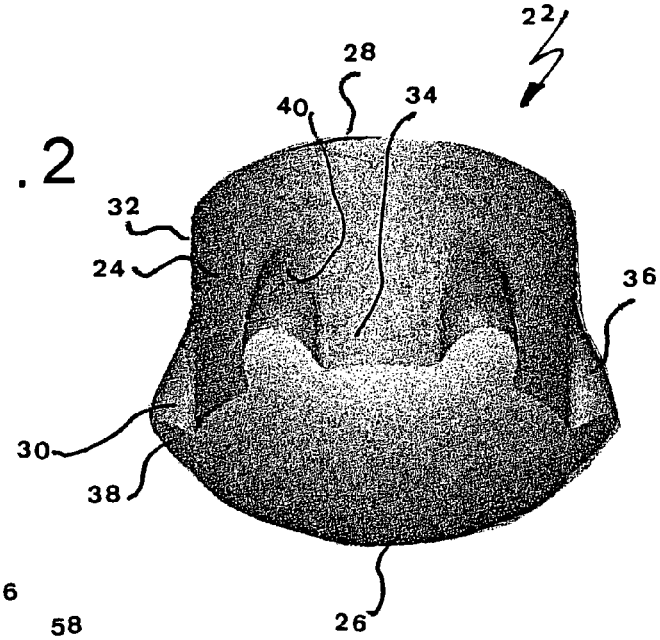
FIG. 2 is a perspective view of a second preferred pellet according to the present invention.

Referring to FIG. 2 there is seen a perspective view of a further preferred pellet 22 according to the present invention having a substantially cylindrical body 24 and two convexly curved end faces 26 and 28. As can be seen, said cylindrical body 24 is provided with a plurality of projections 30 which are in the form of lateral protrusions 30 from substantially vertical surfaces 32 of said substantially cylindrical insert pellet 22 said protrusions 30 being separated from each other by convexly curved surface areas 34 of said insert pellet 22. As will be noted the height H of said protrusions 30 is less than the height h of the cylindrical bodies from which they project.

In this embodiment, said protrusions 30 emerge slantingly from said cylindrical pellet 22, have substantially semi-circular surfaces 36, and an end face 38 that merges with a convexly curved end face 26 of said cylindrical pellet 22. The protrusions 30 have a base 40 of diminishing cross section that merges into vertical surfaces 32 of said pellet 22.

Figure 3:
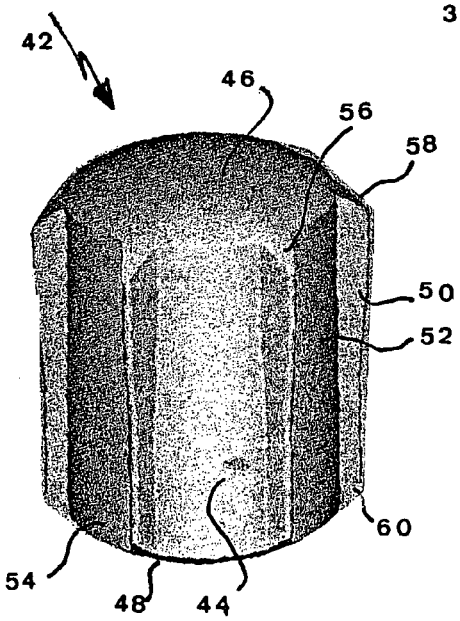
FIG. 3 is a perspective view of a third preferred pellet according to the present invention.

Referring to FIG. 3 there is seen a perspective view of a further preferred pellet 42 according to the present invention having a substantially cylindrical body 44 and two convexly curved end faces 46 and 48. As can be seen, said cylindrical body 44 is provided with a plurality of projections 50 which are in the form of lateral protrusions 50 from substantially vertical surfaces 52 of said substantially cylindrical insert pellet 42 said protrusions 50 being separated from each other by convexly curved surface areas 54 of said insert pellet 42. As will be noted the height H of said protrusions 50 is less than the height h of the cylindrical bodies from which they project.

In this embodiment, said projections 50 are substantially in the form of outwardly tapered triangular prisms 56 with a beveled end faces 58 and 60 respectively merging into an adjacent convexly curved end face 46 and 48 of said cylindrical pellet 42.

Figure 4A:
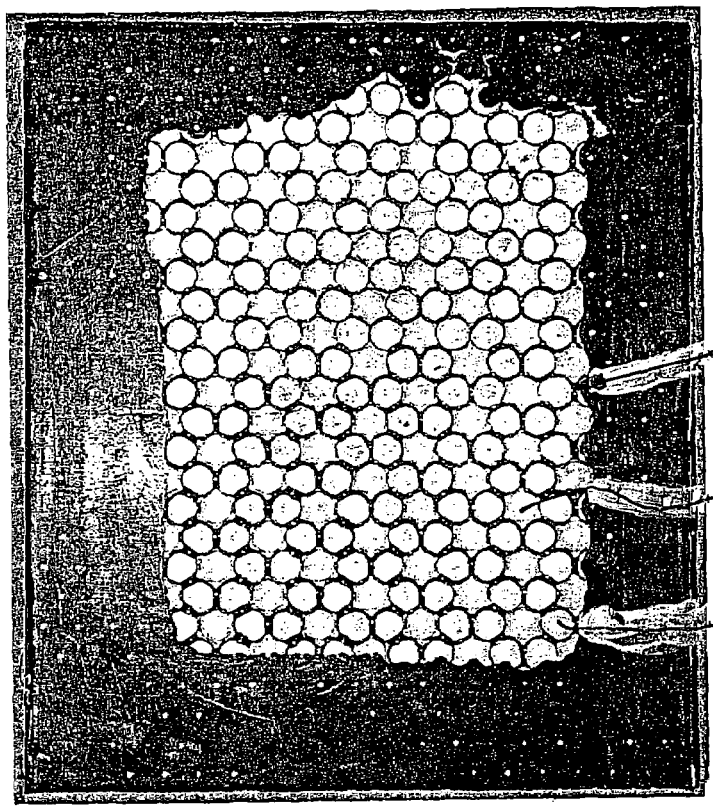
Figure 4B:
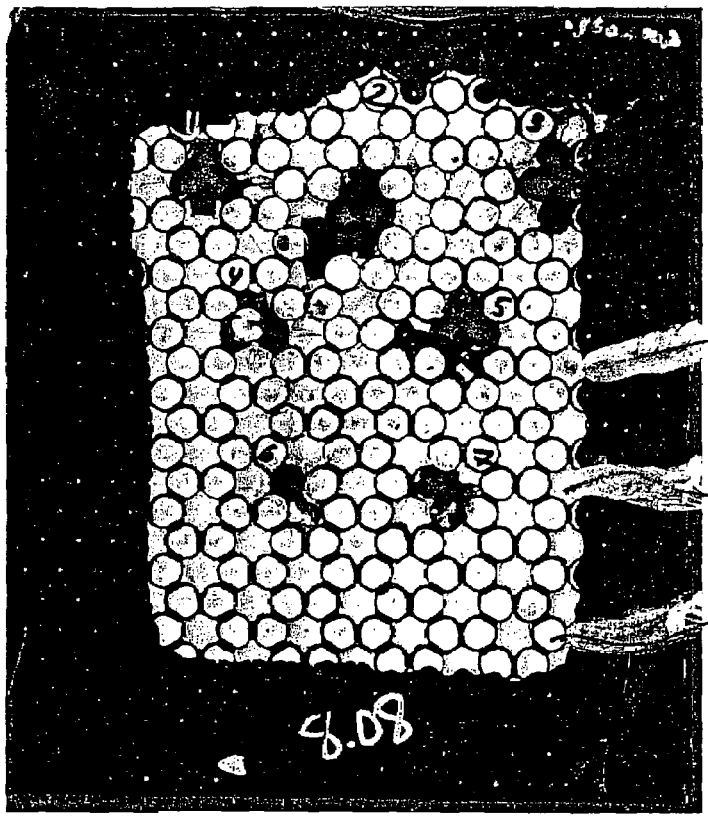
Figure 4C:
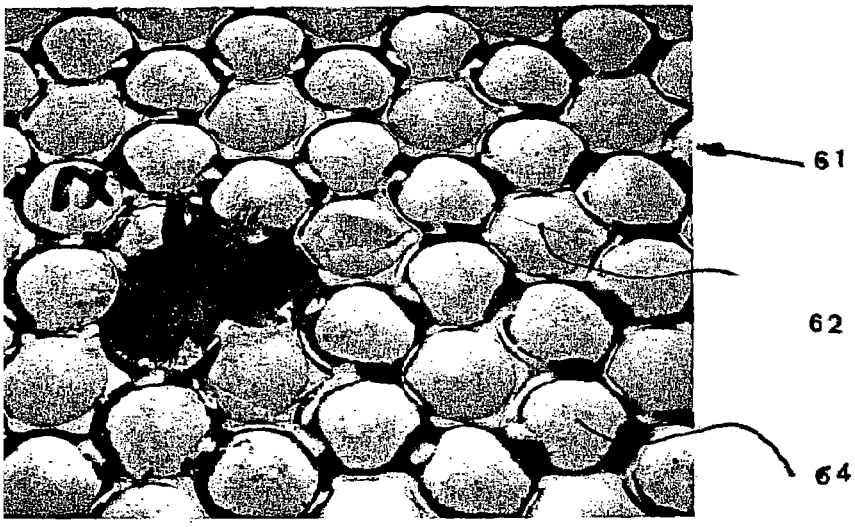
Figure 4D:
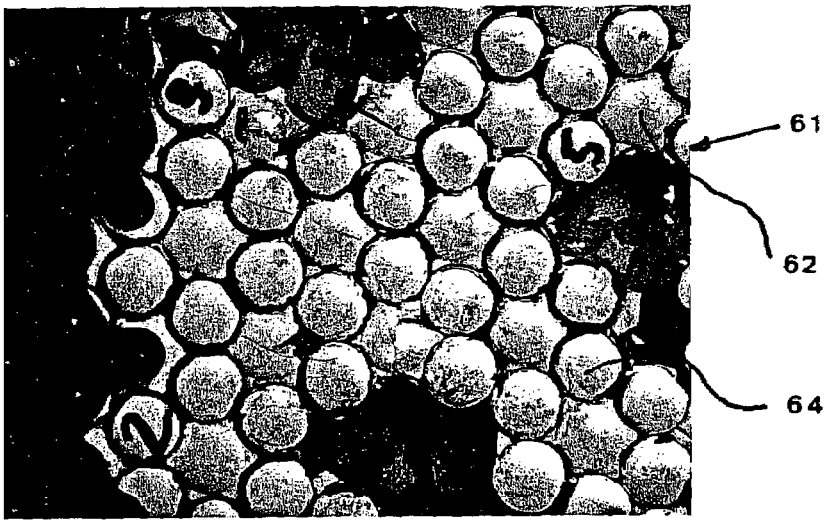

Referring to FIG. 4*a*, there is seen a first picture of a panel 61 according to U.S. Pat. No. 6,408,734, having special interstices-filling pellets 62 in the form of a six-sided star with concave sides, complimentary to the convex curvature of the sides of 6 adjacent cylindrical pellets 64, before being subjected to a ballistic resistance test.

The second picture 4*b* shows the panel 61 after ballistic testing and the third and fourth pictures 4*c* and 4*d* respectively are enlarged pictures of said panel 61 after ballistic testing.

This panel was hand carried for ballistic testing to H.P. White Laboratory, Inc., which is recognized as the leading ballistic testing laboratory in the U.S.

The ballistic resistance test report of said panel is shown in FIG. 8.

As will be noted, only 1 out of 7 projectiles penetrated said plate, which evidenced excellent multi-hit capability. Nevertheless, an examination of the enlarged third and fourth photographs of FIG. 4 show that pellets adjacent and even removed from the point of projectile impact exhibited cracking which would indicate a reduced ability to withstand further projectiles.

Referring to FIG. 5, there is seen a first enlarged picture of a small portion of panel 63 prepared according to the present invention and having an insert pellet 2 as seen and described with reference to FIG. 1. In the second photograph there is seen the same panel 63 with said insert pellets 2 interdispersed therebetween. It is to be noted that while not totally apparent from said picture, that the projections 10 extend only partially into the spaces 68 formed between the sides of six adjacent cylindrical pellets 66, while blocking a major cross-sectional portion of said spaces 64, each of said projections 10 being in spaced-apart relationship to at least one of the two adjacent cylinders 66 towards which it projects, This panel was hand carried for ballistic testing to H.P. White Laboratory, Inc., which is recognized as the leading ballistic testing laboratory in the U.S.

The ballistic resistance test report of said panel is shown ini FIG. 9.

As will be noted, not a single one of the ten projectiles fired penetrated said plate, evidencing its superior multi-hit capability vis-a-vis the panel of U.S. Pat. No. 6,408,734.

The pellets 2, 22 and 42' are all formed of a ceramic material. Preferred ceramics are sintered oxide, nitrides, carbides and borides of alumina, magnesium, zirconium, tungsten, molybdenum, titanium and silica.

Preferred materials are typically alumina, boron carbide, boron nitride, titanium diboride, silicon carbide, silicon oxide, silicon nitride, magnesium oxide, silicon aluminum oxynitride and mixtures thereof.

Referring to FIG. 6 there is seen a top view of a honeycomb-like structure 70 preformed with openings 72 sized to accommodate cylindrical pellets and openings 74 sized to accommodate insert pellets according to the present invention and especially the insert pellet 22 of FIG. 2.

Referring to FIG. 7 there is seen a top view of the honeycomb-like structure 70 preformed with openings 72 having cylindrical pellets 75 inserted therein and openings 74 having insert pellets 22 according to the present invention inserted therein.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate for absorbing and dissipating kinetic energy from high velocity, armor-piercing projectiles, as well as from soft-nosed projectiles, said plate comprising a single internal layer of pellets which are bound and retained in plate form by an elastic material, substantially internally within said elastic material, such that the pellets are bound in a plurality of rows and columns providing mutual lateral support, said pellets being made of ceramic material, wherein a majority of each of said pellets is substantially in contact with at lest three adjacent pellets and at least a majority of said pellets are substantially cylindrical in shape with at least one convexly-curved end face, further characterized in that spaces formed between said adjacent cylindrical pellets are only partial filled with a material for preventing the flow of soft metal from impacting projectiles through said spaces, said flow-preventing material being integrally formed as part of a special insert pellet, said insert pellet being in the form of a cylinder provided with projections extending only partially into the spaces formed between the sides of six adjacent cylindrical pellets, and blocking a major cross-sectional portion of said spaces, each of said projections being in spaced-apart relationship to at lest one of the two adjacent cylinders towards which it projects, said pellets being bound and retained in plate form by a solidified material, wherein said solidified material and said plate are elastic.

2. A composite armor plate according to claim 1, wherein said projections are in the form of lateral protrusions from substantially vertical surfaces of said substantially cylindrical insert pellet said protrusions being separated from each other by convexly curved surface areas of said insert pellet.

3. A composite armor plate according to claim 1, wherein the height of said projections is less than the height of the cylindrical bodies from which they project.

4. A composite armor plate according to claim 1, wherein said projections are provided with substantially semi-cylindrical surfaces.

5. A composite armor plate according to claim 1, wherein said projections are substantially in the form of outwardly tapered triangular prisms.

6. A composite armor plate according to claim 1, wherein said projections emerge slantingly from said cylindrical pellet, have substantially semi-circular surfaces, and an end face that merges with a convexly curved end face of said cylindrical pellet.

7. A composite armor plate according to claim 1, wherein at least one of the upper and lower faces of said projections are beveled.

8. A composite armor plate according to claim 1, wherein a majority of said pellets have at least one convexly-curved end face oriented to substantially face in the direction of an outer impact receiving major surface of said plate.

9. A composite armor plate according to claim 1, wherein said pellets have at least one axis of at least 9 mm.

10. A composite armor plate according to claim 1, wherein said pellets have at least one axis of at least 20 mm.

11. A composite armor plate according to claim 1, wherein said pellets is formed of a ceramic material selected from the group consisting of sintered oxide, nitrides, carbides and borides of alumina, magnesium, zirconium, tungsten, molybdenum, titanium and silica.

12. A composite armor plate according to claim 1, wherein each of said pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

13. A composite armor plate according to claim 1, characterized in that a channel is provided in a plurality of said pellets to reduce the weight per area thereof.

14. A composite armor plate according to claim 13, wherein said channel occupies a volume of up to 25% of said pellet.

15. An insert pellet for use in a composite armor plate for absorbing and dissipating kinetic energy from high velocity, armor-piercing projectiles, as well as from soft-nosed projectiles, said plate being of the type comprising a single internal layer of pellets which are bound and retained in plate form by an elastic material, substantially internally within said elastic material, such that the pellets are bound in a plurality of rows and columns providing mutual lateral support, said pellets being made of ceramic material, wherein a majority of each of said pellets is substantially in contact with at least three adjacent pellets and at least a majority of said pellets are substantially cylindrical in shape with at least one convexly-curved end face, said insert pellet being in the form of a cylinder provided with projections in the form of lateral protrusions from substantially vertical surfaces of said substantially cylindrical insert pellet said protrusions being separated from each other by convexly curved surface areas of said insert pellet.

16. An insert pellet according to claim 15 wherein the height of said projections is less than the height of the cylindrical body from which they project.

17. An insert pellet according to claim 15, wherein said projections are provided with substantially semi-cylindrical surfaces.

18. An insert pellet according to claim 15 wherein said projections are substantially in the form of outwardly tapered triangular prisms.

* * * * *